US005172718A

United States Patent [19]

Thornburgh

[11] Patent Number: 5,172,718

[45] Date of Patent: Dec. 22, 1992

[54] APPARATUS FOR COLLECTING FLUIDS FROM A LEAKING CEILING

[76] Inventor: Robert P. Thornburgh, 8 Redgate La., Cohasset, Mass. 02025

[21] Appl. No.: 875,296

[22] Filed: Apr. 29, 1992

[51] Int. Cl.[5] ..... B67C 11/00

[52] U.S. Cl. ..... 137/312; 137/357; 137/602

[58] Field of Search ..... 137/312, 313, 357, 314, 137/602

[56] References Cited

U.S. PATENT DOCUMENTS 2,518,569 8/1950 Pierson ..... 137/602 X 4,245,666 1/1981 Norris ..... 137/357

4,633,899 1/1987 Lord ..... 137/312 X

*Primary Examiner*—Martin P. Schwadron

*Assistant Examiner*—Kevin L. Lee

*Attorney, Agent, or Firm*—John P. McGonagle

[57] ABSTRACT

One or more plastic funnel sheets, attachable to any type of ceiling structure, are positioned and attached beneath each drip location. The funnel sheets each have flexible tubing networked together and fed into a special receptacle for temporary storage of the collected fluids. The receptacle has a gauge which indicates fluid depth in the receptacle.

12 Claims, 3 Drawing Sheets

APPARATUS FOR COLLECTING FLUIDS FROM A LEAKING CEILING

BACKGROUND OF THE INVENTION

This invention relates to devices for receiving water from leaking ceilings, and in particular, to an improved device which may be quickly installed to collect and temporarily store fluids simultaneously from one or more ceiling leaks.

When a leak occurs in a place of business, such as an office, store or warehouse, the leaking fluid is often channeled by pipes, duct work, ceiling structure, etc., so that fluid from a single leak will drip onto a room's contents from more than one ceiling location. Although the amount of fluid flowing from a ceiling leak may not be great, leaking fluid is especially disruptive to businesses. Electronic equipment such as computer and communications equipment are especially sensitive to damage by liquids. Inventory stored below a leaking ceiling can be damaged beyond repair. Office workers cannot work in a leaking room. Office files and records may be damaged beyond the ability of a business to recover.

When ceiling leaks occur, it is the usual practice to place a pot, pail, bucket or other receptacle under the leak in order to catch the dripping water. If the leak takes the more usual form of dripping from spaced points, a number of receptacles are required. This is generally found to be an ineffective remedy since the receptacle must be constantly attended and frequently emptied to prevent overflowing. Further, if the leak tends to grow wider or be channeled to new locations, some of the dripping liquid will miss the positioned receptacle.

Prior art devices have been proposed for solving the foregoing problems. U.S. Pat. No. 4,245,666, issued to Sarena K. Norris on Jan. 20, 1981, discloses a funnel shaped sheet held up at the corners by spokes extending upwardly and outwardly from a stand. The stand is telescopic so that its height may be adjusted. The funnel sheet is positioned beneath a leak in the ceiling. A flexible tube passes from the lowest end of the funnel to an out of the way location such as a sink so that water collected in the sheet is continuously drained.

This device works well for a ceiling drip at one location, but will require multiple devices for multiples drips. The device must be centered directly under the drip because of its funnel/ stand arrangement. If the drip is located above equipment, furniture, etc., the device with its stand could not in any practical sense be used. Further, sinks and the like are not always conveniently available for disposing the collected liquid. If the dripping liquid is not water, then a sink may not be usable, even if it were available.

U.S. Pat. No. 4,633,899, issued to Phillip E. Lord on Jan. 6, 1987, discloses a rectangular plastic sheet member adhesively fastened at its four corners to a ceiling underlying a leak. A light flexible tube passes from the center of the sheet to an out of the way location for continuously draining collected water from the sheet.

This device also works well for a ceiling drip at one location, but will require multiple devices for multiples drips. The construction of the ceiling must also be of the type in which the sheet may be directly attached, otherwise the device is not usable. Further, sinks, windows and the like are not always conveniently available for disposing of the collected liquid. If the dripping liquid is not water, then a sink or window may not be usable, even if either were available.

SUMMARY OF THE INVENTION

In view of the foregoing disadvantages inherent in the known types of devices now present in the prior art, the present invention provides an improved device which may be quickly installed to collect and temporarily store fluids simultaneously from one or more ceiling leaks. As such, the general purpose of the present invention, which will be described subsequently in greater detail, is to provide a new and improved apparatus for collecting leaking fluids which has the means to collect dripping fluid from a multiplicity of locations and the means to temporarily store said liquids, regardless of type, until removal.

To attain this, the present invention has a plurality of funnel sheets, attachable to any type of ceiling structure, which are positioned and attached beneath each drip location. The funnel sheets each have flexible tubing networked together and fed into a special receptacle for temporary storage of the collected fluids. The receptacle has a gauge which indicates fluid depth in the receptacle.

The funnel/tubing/receptacle network is fluid tight. The receptacle has a locking cap for handling and transportation. This provides an additional advantage over the prior art when the leaking fluid is or contains hazardous or unsafe materials.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
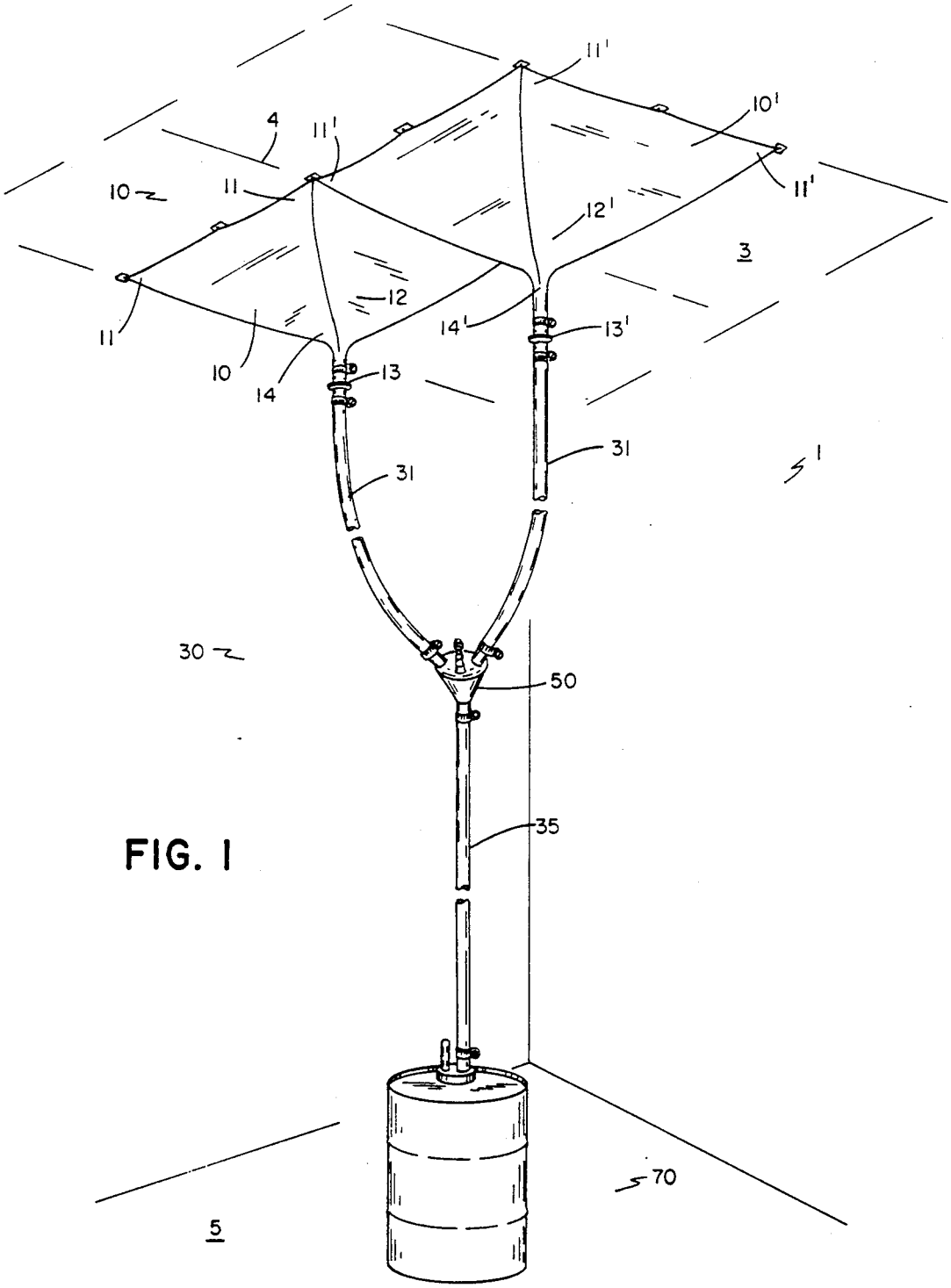
FIG. 1 is a perspective view of a collecting apparatus made in accordance with the present invention.

Referring to the drawings in detail wherein like elements are indicated by like numerals, there is shown an embodiment of the invention 1 incorporating an apparatus for collecting fluids from a leaking ceiling. FIG. 1 illustrates the invention 1 attached to a suspended ceiling grid 3 and resting on a floor 5. The collection apparatus 1 has three major components: one or more collecting members 10, a tubing network 30 and a receptacle 70.

Figure 5:
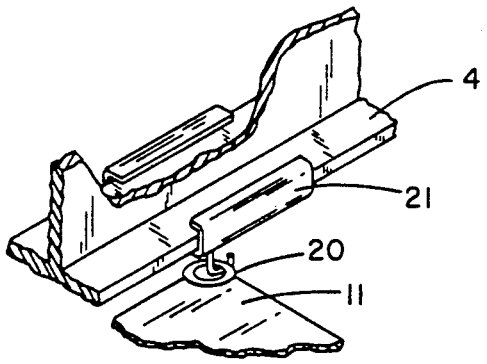
FIG. 5 is a perspective view, partially in section, of the grommet/clamp structure of FIG. 1.

Each collecting member 10 has a generally square, funnel shape and is made of a clear, waterproof plastic sheet having a thickness in the range of six to ten mils. The member 10 is made of clear sheeting so that any build up of debris which may clog the funnel member 10 may be observed. Each member 10 has a grommet 20 welded to each outer corner 11. A plurality of track hook clamps 21 are provided, one for each grommet 20. The track hook clamps 21 are attached to ceiling grid elements 4 at appropriate locations about a drip. The collection member 10 is then installed on the grid 3 by hooking each of its corner grommets 20 onto an appropriately positioned track hook clamp 21. In the embodiment illustrated in FIG. 1, two collecting members 10 and 10' are shown. FIG. 5 illustrates the connection of a grommet 20 to a track hook clamp 21. The center 12 of each collecting member 10 has a funnel shape 14 downwardly projecting from the ceiling grid 3 and terminating in an opening 13. The tubing network 30 is joined to the collecting member central funnel opening 13.

The tubing network 30 is comprised of a receptacle tube 35 and one or more collecting member branch tubes 31. The branch tubes 31 interconnect the collecting members 10 with a junction element 50. The junction element 50 interconnects the branch tubes 31 with the receptacle tube 35. The receptacle tube 35 interconnects the junction element 50 with the receptacle 70. The dripping liquids at various points on the ceiling are gathered and collected by the collecting members 10, funnelled through their central openings 13 to their interconnected branch tubes 31, combined by and passed through the junction element 50 to the receptacle tube 35, and passed through the receptacle tube 35 to the receptacle 70.

Figure 3:
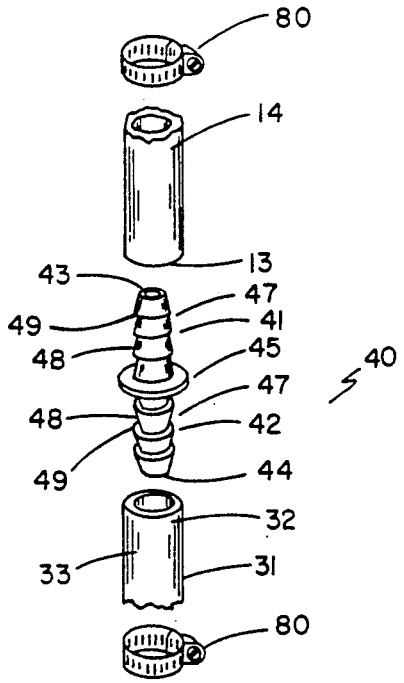
FIG. 3 is an exploded perspective view of the apparatus section defined along the line 3—3 in FIG. 1.

FIG. 3 illustrates the interface between collecting member central opening 13 and branch tube 31. An elongated, generally cylindrical hollow interface element 40 open at both ends 43 and 44 and divided into two mirrored portions 41 and 42 separated by an external radial flange 45 joins the member 10 with the tube 31. Each portion 41, 42 has three radial grooves 47. Each groove 47 has two intersecting radial walls 48 and 49. Each groove wall 49 farthest from the flange 45 lies in a radial plane perpendicular to the longitudinal axis of the interface element 40. Each groove wall 48 closest to the flange 45 lies in a radial plane positioned approximately forty-five degrees from the radial plane of the farther wall 49.

One interface element portion 41 is slid into the collecting member central opening 13 until the interface element radial flange 45 abuts the opening 13. One end 32 of a branch tube 31 is slid over the other interface element portion 42 until the tube end 32 abuts the interface element radial flange 45. The arrangement and shape of the interface element grooves 47 tends to hold the collecting member central opening 13 and tubing 31 in place. For a fluid tight seal, clamps 80 are positioned and fastened around the collecting member neck 14 and tubing section 33 positioned on the interface element portions 42.

Figure 2:
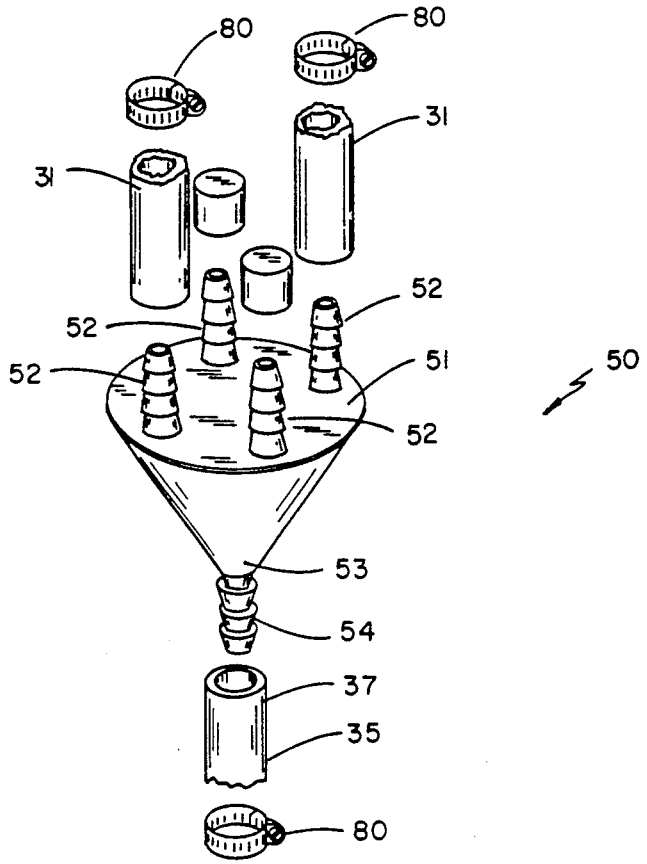
FIG. 2 is an exploded perspective view of the apparatus section defined along the line 2—2 in FIG. 1.

FIG. 2 illustrates the interface between branch tube 31, junction element 50 and receptacle tube 35. The junction element 50 has a hollow inverted conical shape and a flat top surface 51. The flat top surface 51 has four hollow interface protrusions 52 shaped identically to an interface element mirrored portion 41 or 42. The flat top surface 51 corresponds to the interface element radial flange 45. The junction element bottom tip 53 opens into and terminates in a hollow interface protrusion 54 identical in shape to any one of the interface protrusions 52. Each branch tube 31 from a collecting member 10 is joined to an interface protrusion 52 at the top 51 of the junction element 50. A clamp 80 is also installed as with the interface elements 40. Caps 55 are provided to seal off those interface protrusions 52 not currently being used. This maintains the fluid tight seal of the tubing network 30. The receptacle tube 35 is joined to the tip interface protrusion 54 in the same way. A clamp 80 is also installed as with the interface elements 40.

Figure 4:
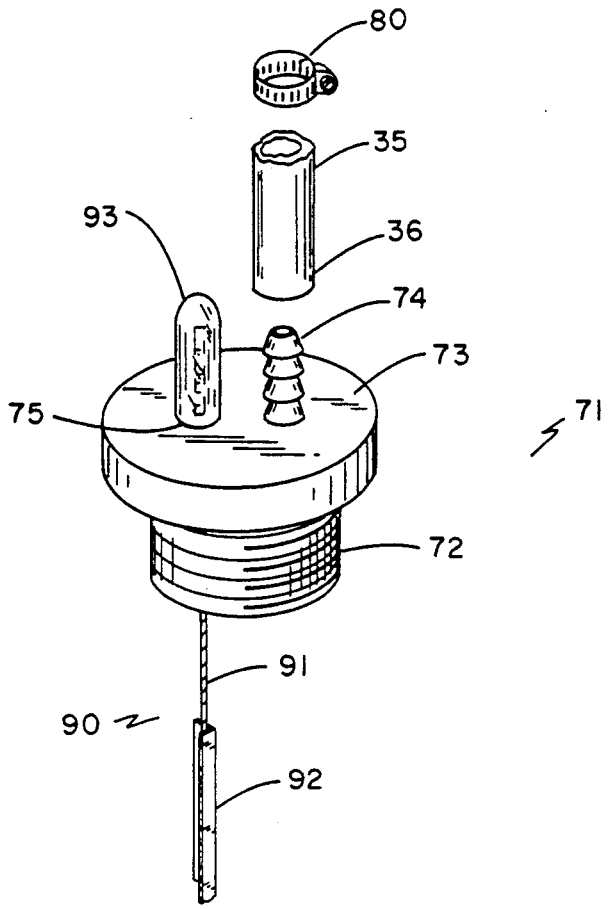
FIG. 4 is an exploded perspective view of the apparatus section defined along the line 4—4 in FIG. 1.

FIG. 1 and 4 illustrate the receptacle 70 and interface therewith. The receptacle 70 in this embodiment is a fifty-five gallon drum made of a material adequate to house the dripping liquid, regardless of whether it is merely water, or if it is an oil, fuel, or other hazardous material. The receptacle 70 is unique with respect to its hollow cap 71 which provides interface means to the tubing network 30 and also contains a gauge 90 which indicates when the receptacle 70 is nearly full.

The cap 71 is threaded along that portion 72 engaging the receptacle 70 itself. The cap has a flat top surface 73 with a hollow, upwardly projecting protrusion 74 shaped identically to an interface element mirrored portion 41 or 42. The flat top surface 73 corresponds to the interface element radial flange 45. One end 36 of the receptacle tube 35 is joined to the cap protrusion 74 in the same manner as the tube's other end 37 was joined to the tip interface protrusion 54. A clamp 80 is also installed as with the interface elements 40

In addition to the protrusion opening 74 the cap has another opening through which a gauge 90 is inserted. The gauge 90 is comprised of a stiff vertical wire 91 connected to a vertical float 92. The unconnected end (not shown) of the wire protrudes into a wire guide (not shown) in the cap 71 and through the guide and then through the cap opening 75. A clear, hollow, enclosed cylindrical cap 93 protrudes from the receptacle cap 71. The gauge cap 93 provides visibility in observing the unconnected end of the 91 wire as it protrudes through the opening 75 into the interior of the gauge cap 93. The enclosed nature of the gauge cap 93 insures the system's fluid tightness. The float 92 - wire 91 interface can be adjusted to signal different levels of receptacle fullness. The guide (not shown) insures that the wire 91 will track into the receptacle cap opening 75 as the receptacle 70 is filled.

A barrel nozzle attachment with shut-off valve may be provided for barrel changing. A fluid-tight cap may be used in place of the normal receptacle cap 71 for handling and transportation of a full receptacle 70. The receptacles can be placed behind counters—away from shoppers or employees or sensitive equipment. The tubing 31 and 35 is flex-tubing and may be of various lengths. The interface elements 40 may be used as tube 31 or 35 extenders. It is understood that the above-described embodiment is merely illustrative of the application. Other embodiments may be readily devised by those skilled in the art which will embody the principles of the invention and fall within the spirit and scope thereof.

I claim:

1. An apparatus for collecting fluids from a leaking ceiling, comprising:

a plurality of collecting members each of which is comprised of a flexible waterproof sheet with a plurality of eyelets, each defining a hole, equally spaced about said sheet's periphery for attachment of said collecting members about said leaking ceiling, wherein each collecting member has a central funnel neck shape downwardly projecting from said ceiling and terminating in an opening;

a tubing network comprised of a plurality of collecting member branch tubes and a receptacle tube wherein said branch tubes interconnect said collecting members with said receptacle tube;

a receptacle interconnected to said branch tubes by means of said receptacle tube; and a junction element interconnecting said branch tubes with said receptacle tube.

2. An apparatus as recited in claim 1, further comprising an elongated, generally cylindrical hollow interface element open at both ends and divided into two mirrored portions separated by an external radial flange, wherein one interface element portion is slid into a collecting member central opening until the interface element radial flange abuts the opening and one end of a branch tube is slid over the other interface element portion until the tube end abuts the interface element radial flange.

3. An apparatus as recited in claim 2, wherein:

each element portion has three radial grooves, each of which has two intersecting radial walls wherein each groove wall farthest from the flange lies in a radial plane perpendicular to the longitudinal axis of the interface element and each groove wall closest to the flange lies in a radial plane positioned approximately forty-five degrees from the radial plane of the farther wall.

4. An apparatus as recited in claim 3, wherein:

said junction element has a hollow inverted conical shape with a flat top surface which has a plurality of hollow interface protrusions protruding therefrom, and a bottom tip opening into and terminating in a hollow interface protrusion, wherein each branch tube from a collecting member is joined to an interface protrusion at the top of the junction element and the receptacle tube is joined to the tip interface protrusion.

5. An apparatus as recited in claim 4, further comprising:

a plurality of caps sealing engaging those top surface interface protrusions not connected to branch tubes.

6. An apparatus as recited in claim 5, further comprising:

a plurality of clamps for sealing attachment around each collecting member neck and tubing section portion positioned on an interface portion and junction element interface protrusion.

7. An apparatus as recited in claim 6, wherein:

said receptacle contains a hollow cap with means for interfacing with said tubing network.

8. An apparatus as recited in claim 7, wherein:

said hollow cap also contains a gauge for indicating liquid level in said receptacle.

9. An apparatus as recited in claim 8, wherein:

said cap is threaded along that portion engaging the receptacle, and has a flat top surface with a hollow, upwardly projecting protrusion, wherein one end of the receptacle tube is joined to the cap protrusion.

10. An apparatus as recited in claim 9, wherein:

said cap has a second opening through which a gauge is inserted.

11. An apparatus as recited in claim 10, wherein:

said gauge is comprised of a stiff vertical wire connected to a vertical float, a hollow wire guide positioned within said cap, wherein the unconnected end of the wire protrudes into said wire guide and through the guide and through said second cap opening, and a clear, hollow, enclosed cylindrical cap attached to and protruding from the receptacle cap, said the gauge cap providing visibility in observing the unconnected end of the wire as it protrudes through the cap second opening into the interior of the gauge cap.

12. An apparatus as recited in claim 11, further comprising:

a barrel nozzle attachment with shut-off valve; and a fluid-tight cap for use in place of said receptacle cap for handling and transportation of a full receptacle.

* * * * *